US009075342B2

(12) United States Patent
Kuramashi

(10) Patent No.: US 9,075,342 B2
(45) Date of Patent: Jul. 7, 2015

(54) DEVELOPER CONVEYING DEVICE, AND DEVELOPING DEVICE AND IMAGE FORMING APPARATUS PROVIDED WITH SAME

(71) Applicant: KYOCERA Document Solutions Inc., Osaka (JP)

(72) Inventor: Koji Kuramashi, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 13/938,525

(22) Filed: Jul. 10, 2013

(65) Prior Publication Data

US 2014/0023401 A1 Jan. 23, 2014

(30) Foreign Application Priority Data

Jul. 19, 2012 (JP) ..... 2012-160841

(51) Int. Cl.
*G03G 15/08* (2006.01)

(52) U.S. Cl.
CPC ..... *G03G 15/0839* (2013.01); *G03G 15/0893* (2013.01); *G03G 2215/0833* (2013.01); *G03G 2215/0838* (2013.01); *G03G 15/0877* (2013.01)

(58) Field of Classification Search
CPC ..... G03G 15/0893; G03G 15/0839
USPC ..... 399/254, 256
See application file for complete search history.

(56) References Cited

U.S. PATENT DOCUMENTS

| | | | | |
|---|---|---|---|---|
| 4,980,724 | A * | 12/1990 | Tanaka | 399/256 |
| 6,834,175 | B2 * | 12/2004 | Murayama et al. | 399/256 |
| 7,251,440 | B2 * | 7/2007 | Shigeta et al. | 399/254 |
| 7,881,640 | B2 * | 2/2011 | Iwata et al. | 399/254 |
| 2009/0214268 | A1 | 8/2009 | Noh et al. | |

(Continued)

FOREIGN PATENT DOCUMENTS

| | | | |
|---|---|---|---|
| JP | 2004-307140 | | 11/2004 |
| JP | 2006-162810 | * | 6/2006 |

(Continued)

OTHER PUBLICATIONS

Japanese Patent Application No. 2012-160841—Office Action Issued Nov. 11, 2014.

*Primary Examiner* — Sandra Brase
(74) *Attorney, Agent, or Firm* — Gerald E. Hespos; Michael J. Porco; Matthew T. Hespos

(57) ABSTRACT

A developer conveying device includes a housing with a pair of wall portions, a developer conveyance path extending between the pair of wall portions, and a conveying member. The conveying member is rotatably supported on the wall portions and conveys developer from one wall portion to the other. This conveying member includes a spiral member, shaft portions and a breaking member. The spiral member is formed by connecting spiral pieces, each forming one spiral turn, in a conveying direction of the developer and includes a hollow interior defined by the connected spiral pieces. The shaft portions are arranged at opposite end parts of the spiral member and rotatably supported on the wall portions and serve as a rotary shaft for the rotation of the conveying member. The breaking member extends across the hollow interior in a direction intersecting with the conveying direction.

16 Claims, 11 Drawing Sheets

(56) References Cited

U.S. PATENT DOCUMENTS

| | | | | |
|---|---|---|---|---|
| 2011/0188894 | A1* | 8/2011 | Mihara et al. | 399/256 |
| 2012/0014719 | A1 | 1/2012 | Hayashi et al. | |

FOREIGN PATENT DOCUMENTS

| | | |
|---|---|---|
| JP | 2006162810 | 6/2006 |
| JP | 2007101928 | 4/2007 |

* cited by examiner

DEVELOPER CONVEYING DEVICE, AND DEVELOPING DEVICE AND IMAGE FORMING APPARATUS PROVIDED WITH SAME

This application is based on Japanese Patent Application Serial No. 2012-160841 filed with the Japan Patent Office on Jul. 19, 2012, the contents of which are hereby incorporated by reference.

BACKGROUND

The present disclosure relates to a developer conveying device and a developing device and an image forming apparatus provided with the same.

Conventionally, a developing device in which an agitating screw is mounted in a developer housing is known as a developer conveying device for conveying developer. The agitating screw of the developing device is composed of a shaft portion and a spiral piece arranged around the shaft portion. In the developer housing, the developer is conveyed in a predetermined conveying direction by driving and rotating the agitating screw.

If an adhesion force of the developer increases with the deterioration of the developer, the developer may adhere to the shaft portion. If the developer adheres to the shaft portion, virtual shaft thickening of the agitating screw occurs to reduce the conveying performance of the agitating screw. To solve the shaft thickening of the agitating screw described above, some developing devices use an agitating screw including no shaft part, i.e. having a hollow shape in an axial central part thereof.

With the above agitating screw, the developer being conveyed in the hollow part of the agitating screw may aggregate in the developer housing. Such aggregation of the developer becomes notable in a high-temperature environment and when the developer is deteriorated. Particularly, in the agitating screw having the hollow shape, the developer may cylindrically aggregates.

An object of the present disclosure is to suppress the cylindrical aggregation of developer in a hollow part in a developer conveying device including a developer conveying member having a hollow shape.

SUMMARY

A developer conveying device according to one aspect of the present disclosure includes a housing with a pair of wall portions, a developer conveyance path extending between the pair of wall portions and a conveying member.

The conveying member is rotatably supported on the wall portions and conveys developer from one wall portion to the other. This conveying member includes a spiral member, shaft portions and a breaking member. The spiral member is formed by connecting spiral pieces, each forming one spiral turn, in a conveying direction of the developer and includes a hollow interior defined by the connected spiral pieces. The shaft portions are arranged at opposite end parts of the spiral member and rotatably supported on the wall portions and serve as a rotary shaft for the rotation of the conveying member. The breaking member extends across the hollow interior in a direction intersecting with the conveying direction.

A developing device according to another aspect of the present disclosure includes a developing roller rotatably supported in the housing and configured to carry developer in addition to the configuration of the above developer conveying device.

An image forming apparatus according to still another aspect of the present disclosure includes an image bearing member configured such that an electrostatic latent image is to be formed on a circumferential surface thereof, and arranged to face the developing roller in addition to the configuration of the above developing device.

These and other objects, features and advantages of the present disclosure will become more apparent upon reading the following detailed description along with the accompanying drawings.

DETAILED DESCRIPTION

Figure 1:
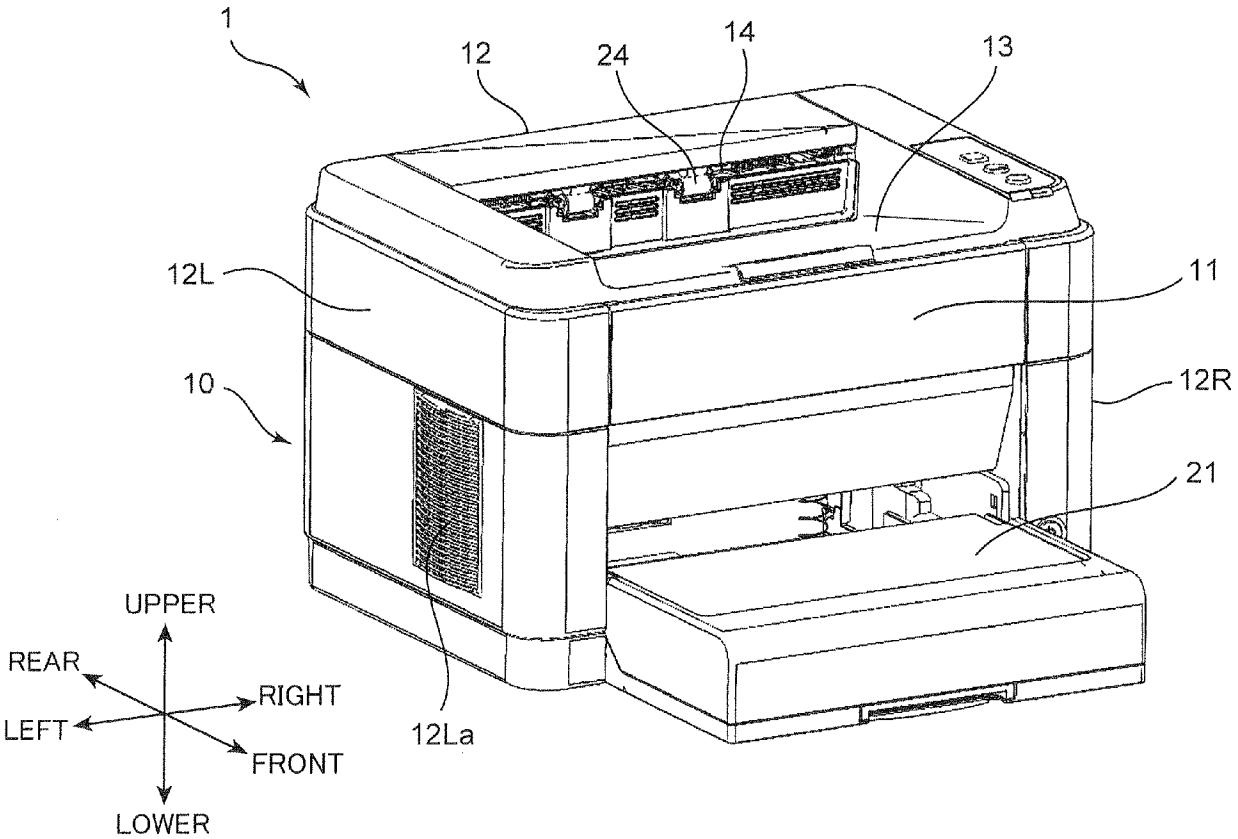
FIG. 1 is a perspective view showing the external appearance of an image forming apparatus according to one embodiment of the present disclosure.
Figure 2:
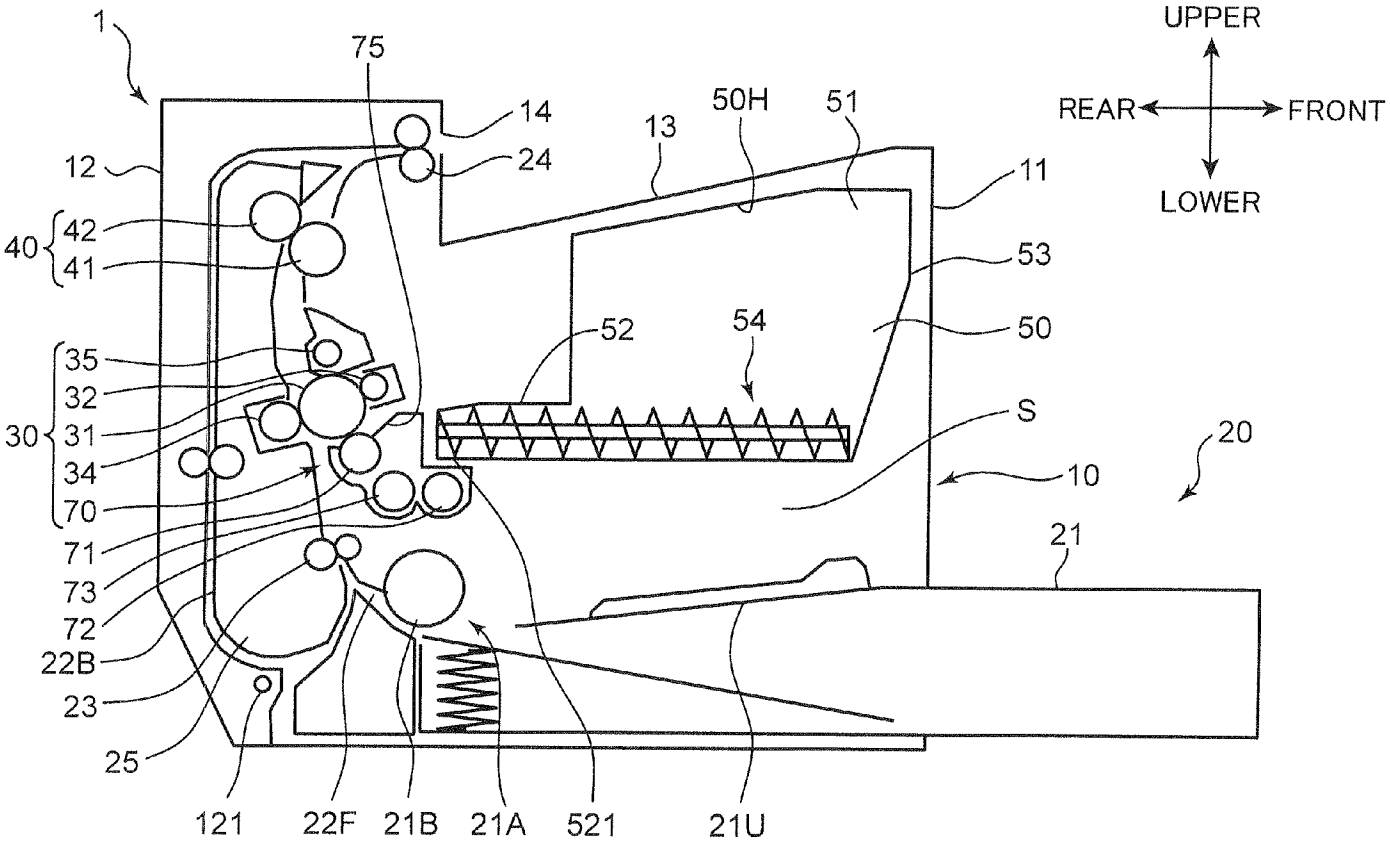
FIG. 2 is a sectional view showing the internal structure of the image forming apparatus.

Hereinafter, embodiments of the present disclosure are described with reference to the drawings. FIG. 1 is a perspective view showing the external appearance of an image forming apparatus 1 according to one embodiment of the present disclosure. FIG. 2 is a side view in section showing the internal structure of the image forming apparatus 1. Although a black-and-white printer is illustrated as the image forming apparatus 1 here, the image forming apparatus may be a copier, a facsimile machine or a complex machine provided with these functions, or an image forming apparatus for forming a color image.

The image forming apparatus 1 includes a main body housing having a substantially rectangular parallelepipedic housing structure, and a sheet feeding unit 20, an image forming unit 30, a fixing unit 40 and a toner container 50 housed in this main body housing 10.

A front cover 11 and a rear cover 12 are respectively provided on a front surface side and a rear surface side of the main body housing 10. By opening the front cover 11, the toner container 50 is exposed to the front side. This enables a user to take out the toner container 50 from the front surface side of the main body housing 10 when toner runs out. The rear cover 12 is a cover which is opened at the time of a sheet jam or maintenance. The respective image forming unit 30 and fixing unit 40 can be taken out from the rear surface side of the main body housing 10 by opening the rear cover 12. Further, a left cover 12L (FIG. 1) and a right cover 12R opposite to the left cover 12L are respectively so arranged on side surfaces of the main body housing 10 as to extend in a vertical direction. An air inlet 12La through which air is taken into the main body housing 10 is arranged in a front part of the left cover 12L. A sheet discharging portion 13 to which a sheet after image formation is to be discharged is provided on the upper surface of the main body housing 10. Various devices for performing image formation are housed in an inner space S (FIG. 2) defined by the front cover 11, the rear cover 12, the left cover 12L, the right cover 12R and the sheet discharging portion 13.

The sheet feeding unit 20 includes a sheet cassette 21 for storing sheets to which an image forming process is to be applied (FIG. 2). A part of this sheet cassette 21 projects further forward from the front surface of the main body housing 10. The upper surface of a part of the sheet cassette 21 housed in the main body housing 10 is covered by a sheet cassette ceiling plate 21U. The sheet cassette 21 includes a sheet storage space in which a stack of the sheets is stored, a lift plate for lifting up the stack of sheets for sheet feeding, and the like. A sheet pickup unit 21A is provided above a rear end side of the sheet cassette 21. A feed roller 21B for picking up the uppermost sheet of the sheet stack in the sheet cassette 21 one by one is arranged in this sheet pickup unit 21A.

The image forming unit 30 performs an image forming process for forming a toner image on a sheet fed from the sheet feeding unit 20. The image forming unit 30 includes a photoconductive drum 31 (image bearing member) and a charging device 32, an exposure device (not shown in FIG. 2), a developing device 70, a transfer roller 34 and a cleaning device 35 arranged around this photoconductive drum 31. The image forming unit 30 is arranged between the left cover 12L and the right cover 12R.

The photoconductive drum 31 includes an unillustrated rotary shaft and a cylindrical surface which rotates about the rotary shaft. An electrostatic latent image is to be formed on this cylindrical surface and a toner image in conformity with this electrostatic latent image is to be carried on the cylindrical surface. A photoconductive drum made of an amorphous silicon (a-Si) based material can be used as the photoconductive drum 31.

The charging device 32 is for uniformly charging the surface of the photoconductive drum 31 and includes a charging roller held in contact with the photoconductive drum 31.

The cleaning device 35 includes an unillustrated cleaning blade and cleans toner adhering to the cylindrical surface of the photoconductive drum 31 after the transfer of the toner image and conveys this toner to an unillustrated collecting device. Note that the photoconductive drum 31, the charging device 32 and the cleaning device 35 are integrally configured as an unillustrated drum unit.

The exposure device includes optical devices such as a laser light source, a mirror and a lens and irradiates the circumferential surface of the photoconductive drum 31 with light modulated based on image data input from an external apparatus such as a personal computer, thereby forming an electrostatic latent image.

The developing device 70 supplies toner to the circumferential surface of the photoconductive drum 31 to develop the electrostatic latent image formed on the photoconductive drum 31 and to form a toner image. The developing device 70 includes a developing roller 71 for bearing the toner to be supplied to the photoconductive drum 31 and a first conveyor screw 72 and a second conveyor screw 73 for conveying developer in a circulating manner while agitating the developer in an unillustrated developer housing. The photoconductive drum 31 is arranged to face the developing roller 71. Note that the developing device 70 is described in detail later.

The transfer roller 34 is a roller for transferring the toner image formed on the circumferential surface of the photoconductive drum 31 onto a sheet. The transfer roller 34 forms a transfer nip portion by coming into contact with the circumferential surface of the photoconductive drum 31. A transfer bias having a polarity opposite to that of the toner is applied to this transfer roller 34.

The fixing unit 40 performs a fixing process for fixing a transferred toner image onto a sheet. The fixing unit 40 includes a fixing roller 41 internally provided with a heat source and a pressure roller 42 pressed in contact with this fixing roller 41 and forming a fixing nip portion between the fixing roller 41 and itself. When a sheet having a toner image transferred thereto is passed through the fixing nip portion, the toner image is fixed onto the sheet by heating by the fixing roller 41 and pressing by the pressure roller 42.

The toner container 50 stores the toner to be supplied to the developing device 70. The toner container 50 includes a container main body 51 as a main storage part for the toner, a tubular portion 52 projecting from a lower part of one side surface of the container main body 51, a lid member 53 covering the other side surface of the container main body 51, and a rotary member 54 housed in the container for conveying the toner. The toner stored in the toner container 50 is supplied into the developing device 70 through a toner discharge opening 521 provided on the lower surface of the leading end of the tubular portion 52 by driving and rotating the rotary member 54. Further, a container ceiling plate 50H covering an upper side of the toner container 50 is located below the sheet discharging portion 13.

A main conveyance path 22F and a reversing conveyance path 22B are provided to convey a sheet in the main body housing 10. The main conveyance path 22F extends from the sheet pickup unit 21A of the sheet feeding unit 20 to a sheet discharge opening 14 provided to face the sheet discharging portion 13 on the upper surface of the main body housing 10 by way of the image forming unit 30 and the fixing unit 40. The reversing conveyance path 22B is a conveyance path for returning a sheet, one side of which is printed, to a side of the main conveyance path 22F upstream of the image forming unit 30 in the case of printing both sides of the sheet.

The main conveyance path 22F extends to pass the transfer nip portion formed by the photoconductive drum 31 and the transfer roller 34 from a lower side to an upper side. A pair of registration rollers 23 are arranged in a side of the main conveyance path 22F upstream of the transfer nip portion. A sheet is temporarily stopped at the pair of registration rollers 23 and fed to the transfer nip portion at a predetermined timing for image transfer after a skew correction is made. A plurality of conveyor rollers for conveying a sheet are arranged at suitable positions of the main conveyance path 22F and the reversing conveyance path 22B. For example, a pair of discharge rollers 24 are arranged near the sheet discharge opening 14.

The reversing conveyance path 22B is formed between the outer side surface of a reversing unit 25 and the inner surface of the rear cover 12 of the main body housing 10. The transfer roller 34 and one of the pair of registration rollers 23 are mounted on the inner side surface of the reversing unit 25. The rear cover 12 and the reversing unit 25 are respectively rotatable about a supporting point portion 121 provided at the lower ends thereof. If a sheet jam occurs in the rear conveyance path 22B, the rear cover 12 is opened. If a sheet jam occurs in the main conveyance path 22F or if the unit including the photoconductive drum 31 or the developing device 70 is taken out to the outside, the reversing unit 25 is also opened in addition to the rear cover 12.

<Detailed Configuration of Developing Device>

Figure 3B:
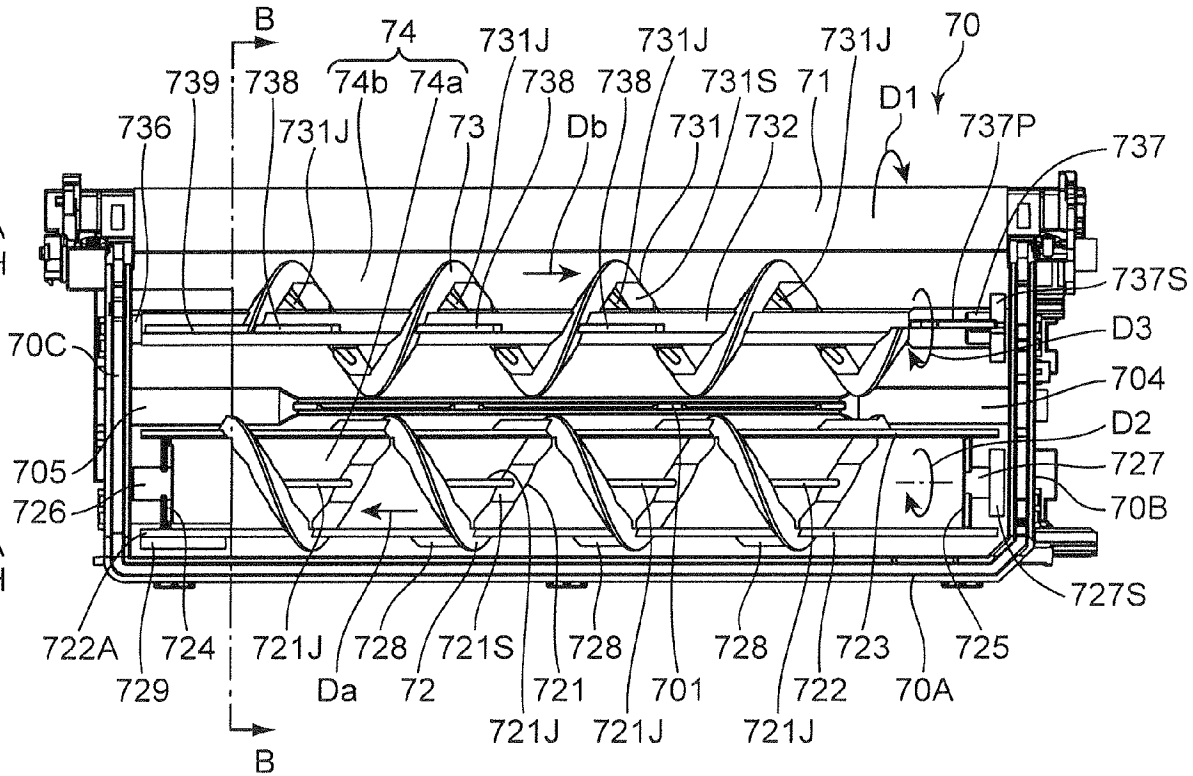
FIG. 3A is a sectional view of first and second conveyor screws according to one embodiment of the present disclosure arranged in a developing device and FIG. 3B is a plan view of a developer housing of the developing device.
Figure 3A:
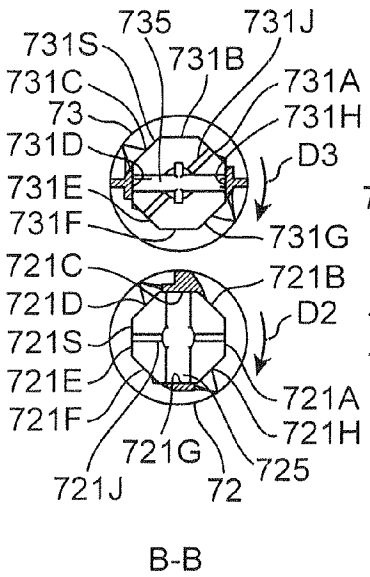

Next, with reference to FIGS. 3A and 3B, the configuration of the developing device 70 according to this embodiment is described in detail. FIG. 3A is a sectional view of the first and second conveyor screws 72, 73 arranged in the developing device 70 and FIG. 3B is a plan view of a developer housing 70A of the developing device 70. Note that FIG. 3B shows a state where a lid portion (not shown) of the developer housing 70A is removed.

The developing device 70 includes the developer housing 70A (housing) defining an inner space of the developing device 70. The developer housing 70A includes the unillustrated lid portion for covering respective rollers housed therein from above and a bottom portion forming a lower surface portion of the developer housing 70A. A bottom side of the developer housing 70A appears in FIG. 3B. The developer housing 70A includes a first wall portion 70B and a second wall portion 70C which are a pair of wall portions.

The developer housing 70A includes a developer storage 74 which is a cavity for storing developer composed of magnetic toner (one-component toner) and capable of conveying the developer while agitating it. The developing roller 71, a developer restricting blade 75 (FIG. 2) arranged to face the developing roller 71 and the first and second conveyor screws 72, 73 for agitating and conveying the developer are arranged in the developer housing 70A.

The developer storage 74 includes two adjacent first and second conveying portions 74*a*, 74*b* (both are developer conveyance paths) extending in a longitudinal direction of the developing device 70 between the first and second wall portions 70B, 70C. The first and second conveying portions 74*a*, 74*b* are partitioned from each other by a partition plate 701 formed integrally to the bottom portion of the developer housing 70A and extending in the longitudinal direction. The first and second conveying portions 74*a*, 74*b* communicate with each other via a first communicating portion 704 and a second communicating portion 705 at opposite end parts in the longitudinal direction.

The first conveyor screw 72 (conveying member) and a second conveyor screw 73 (conveying member) are respectively housed in the first conveying portion 74*a* and the second conveying portion 74*b* and agitate and convey the developer by being rotated about shafts. Specifically, the first and second conveyor screws 72, 73 are rotatably supported on the first and second wall portions 70B, 70C and convey the developer from one of the first and second wall portions 70B, 70C toward the other. As shown in FIG. 3A, the first conveyor screw 72 is driven and rotated in a direction of an arrow D2 (clockwise direction) and, similarly, the second conveyor screw 73 is driven and rotated in a direction of an arrow D3 which is a clockwise direction. The first and second conveyor screws 72, 73 are so set that developer conveying directions thereof are opposite to each other along an axial direction. This causes the developer to be conveyed in a circulating manner between the first and second conveying portions 74*a*, 74*b* as shown by arrows Da, Db in FIG. 3B while being agitated.

The developing roller 71 is rotatably supported by the developer housing 70A and arranged along the longitudinal direction of the developing device 70 and adjacent to the second conveyor screw 73. In FIG. 3B, the developing roller 71 is driven and rotated in a direction of an arrow D1. A fixed so-called magnet roll is arranged in the developing roller 71. The magnet roll includes a plurality of magnetic poles. The developer is supplied from the second conveyor screw 73 to the circumferential surface of the developing roller 71. Then, the developer carried on the circumferential surface of the developing roller 71 is conveyed to a downstream side in a rotation direction of the developing roller 71 as the developing roller 71 is rotated.

In a circumferential direction of the developing roller 71, the developer restricting blade 75 (FIG. 2) is arranged downstream of an area, where the developing roller 71 and the second conveyor screw 73 are facing each other, in the rotation direction of the developing roller 71. The developer restricting blade 75 is mounted on the unillustrated lid portion of the developer housing 70A to extend in an axial direction of the developing roller 71. The developer restricting blade 75 is a plate-like member, a leading end part of which is arranged at a predetermined distance from the circumferential surface of the developing roller 71. The thickness of a layer of the developer carried on the developing roller 71 is restricted by the developer restricting blade 75. The layer of the developer on the developing roller 71 restricted in thickness by the developer restricting blade 75 is conveyed to a part where the developing roller 71 and the photoconductive drum 31 are facing each other, and supplied to the cylindrical surface of the photoconductive drum 31 in accordance with an electrostatic latent image formed on the photoconductive drum 31.

Figure 4:
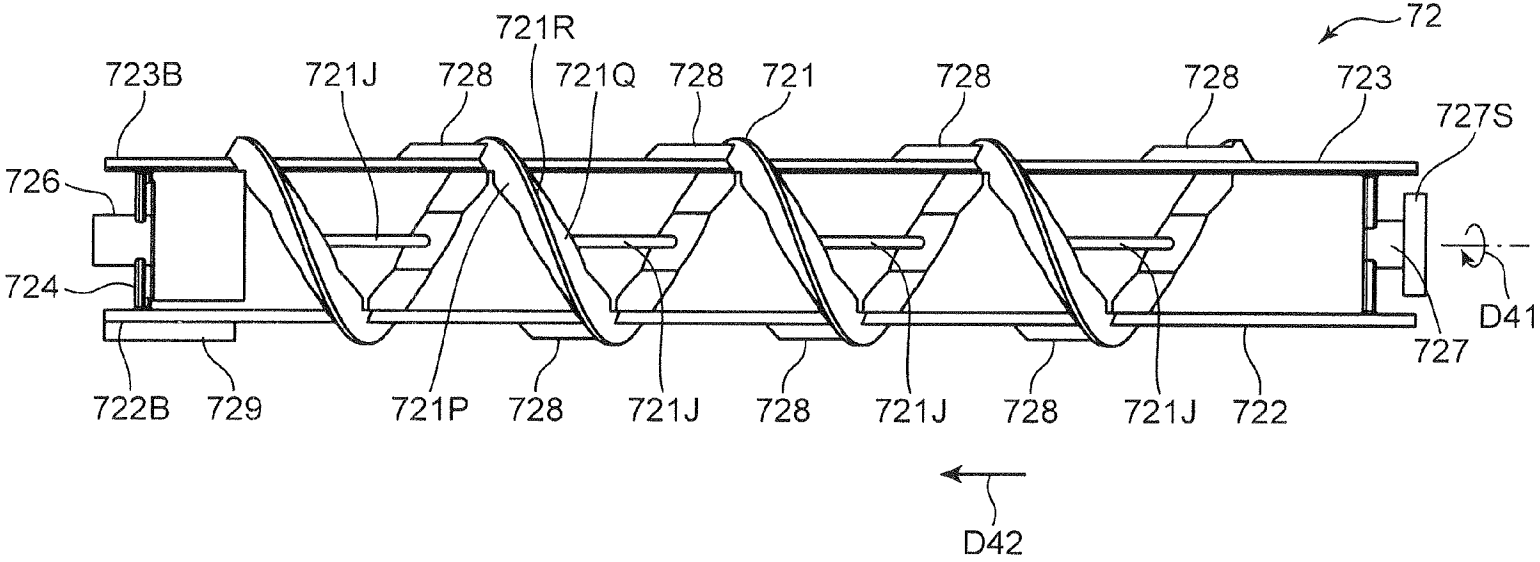
FIG. 4 is a front view of the first conveyor screw.
Figure 5:
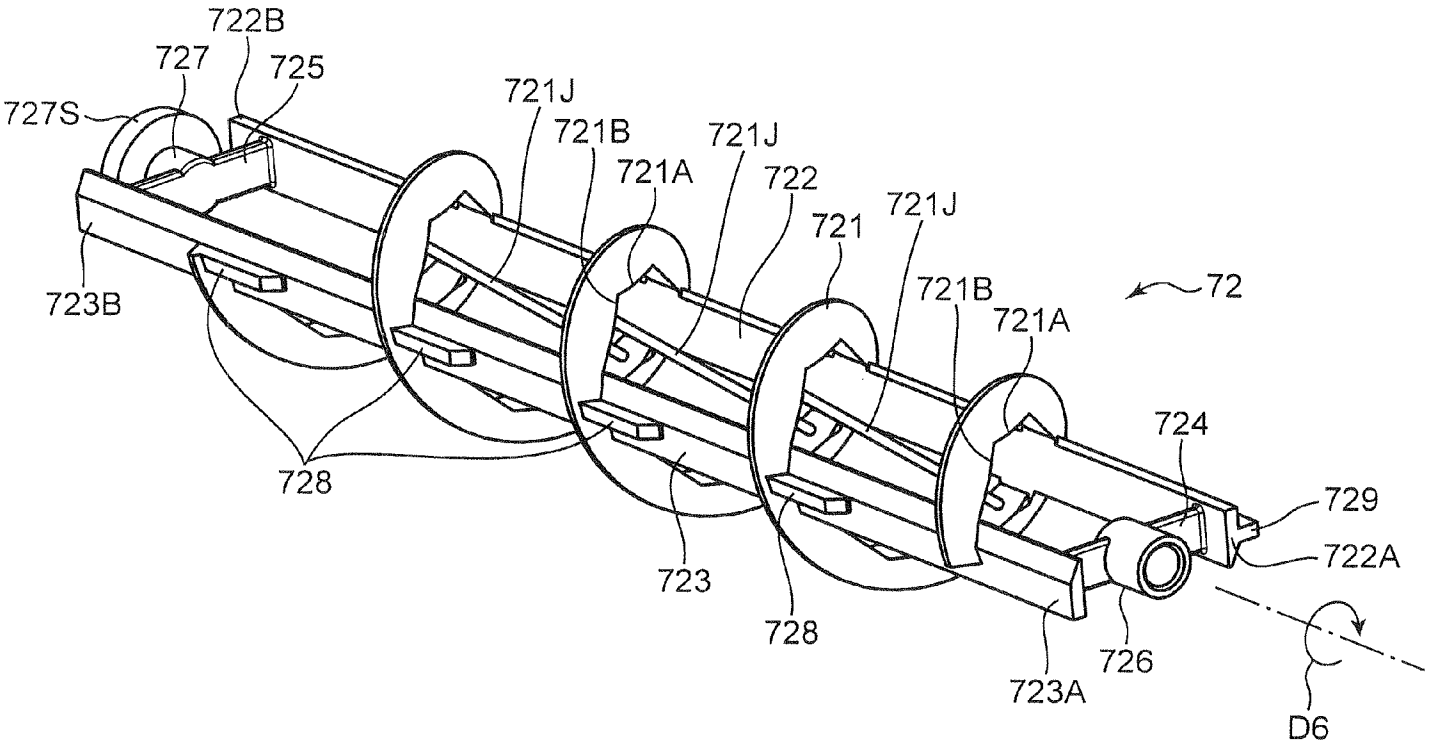
FIG. 5 is a perspective view of the first conveyor screw.
Figure 6:
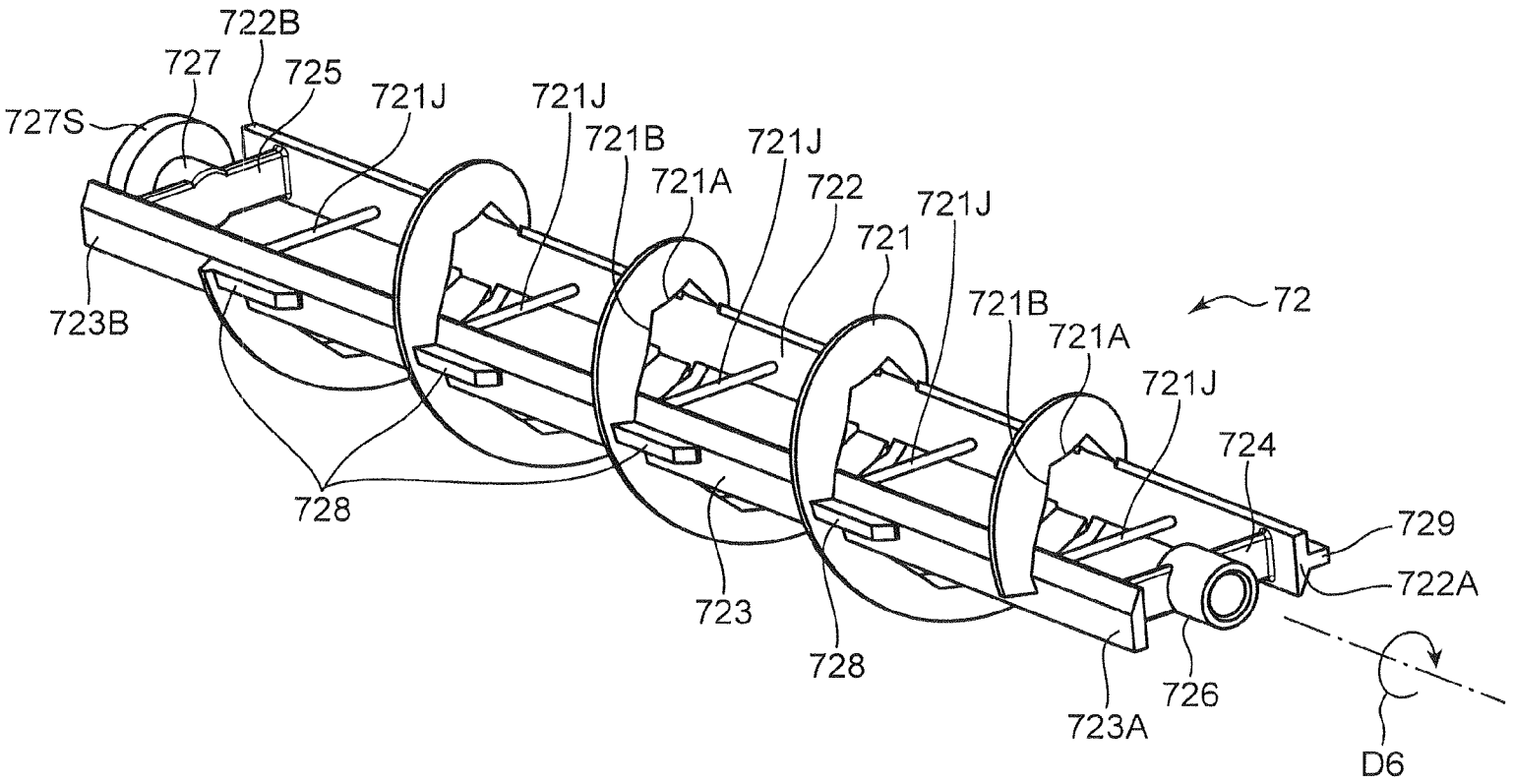
FIG. 6 is a perspective view of a conveyor screw according to another embodiment.
Figure 7:
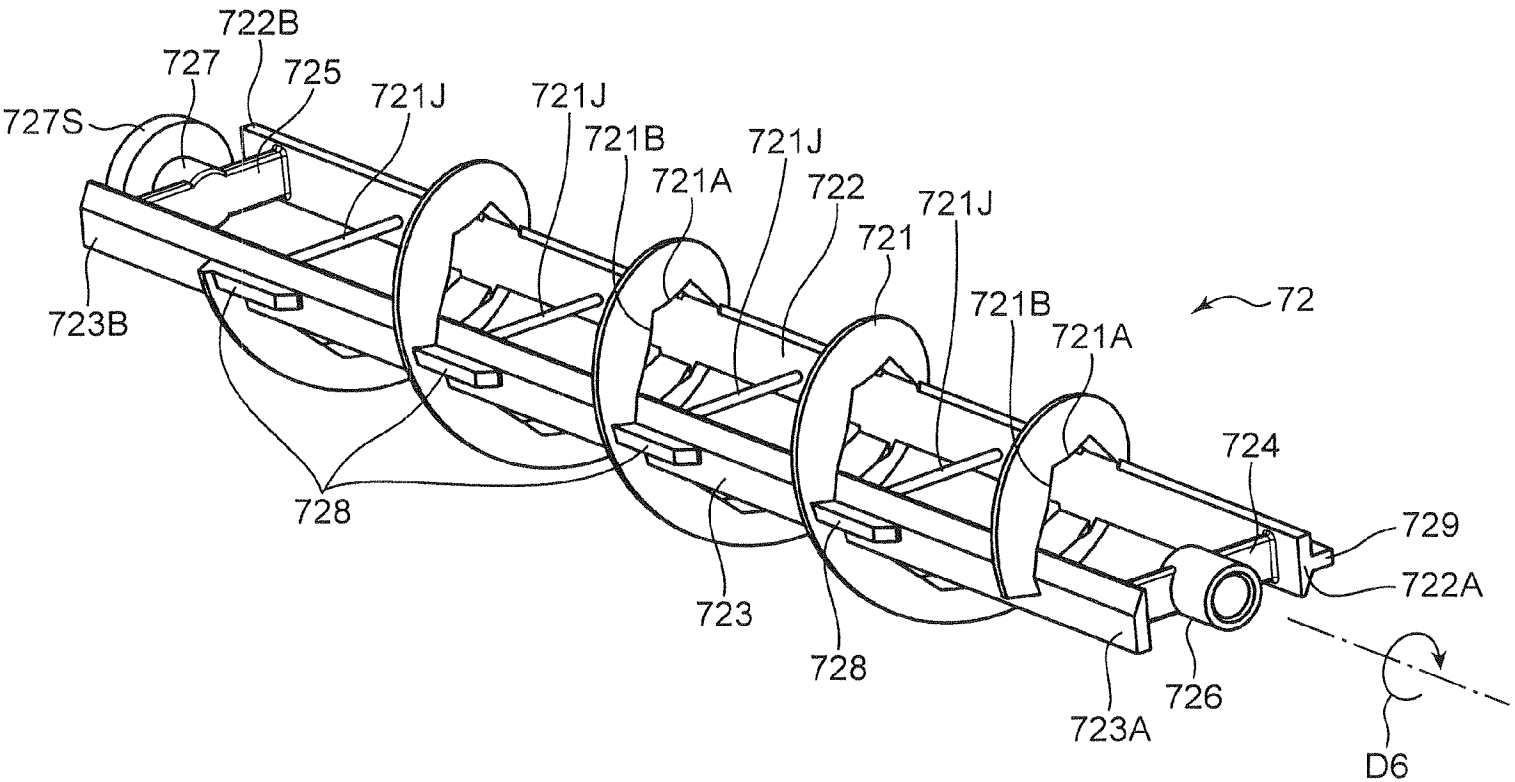
FIG. 7 is a perspective view of a conveyor screw according to still another embodiment.
Figure 8:
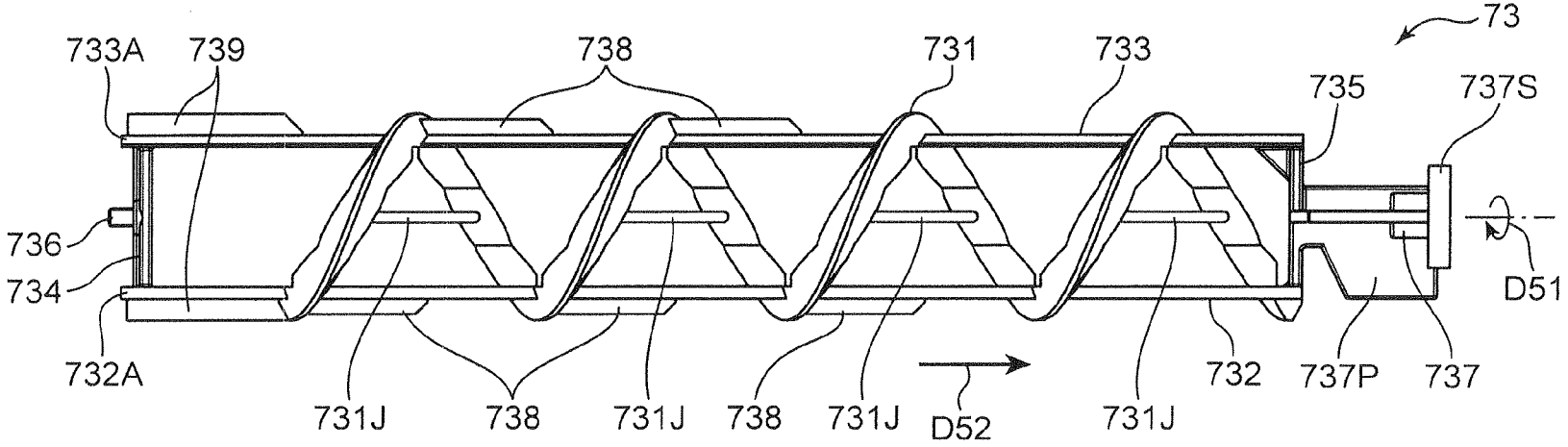
FIG. 8 is a plan view of the second conveyor screw.
Figure 9:
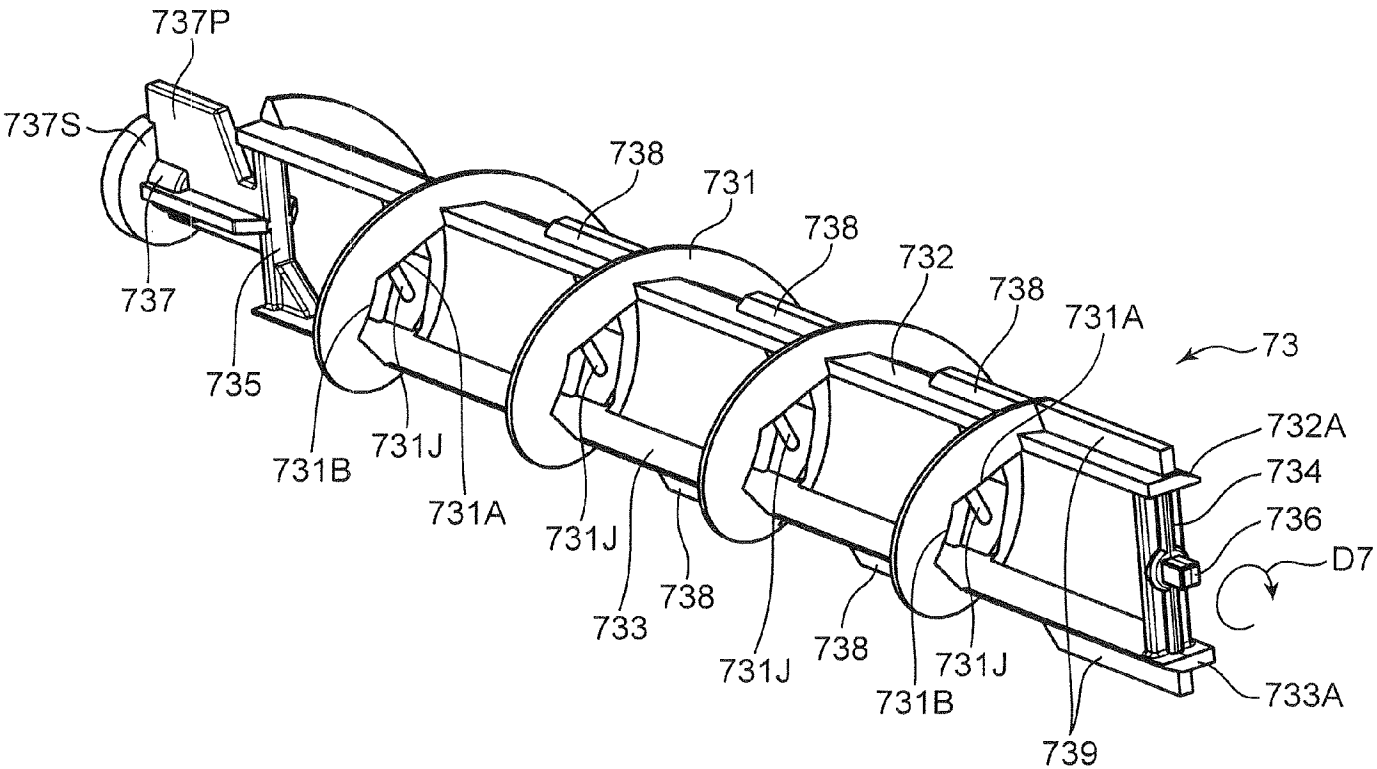
FIG. 9 is a perspective view of the second conveyor screw.
Figure 10:
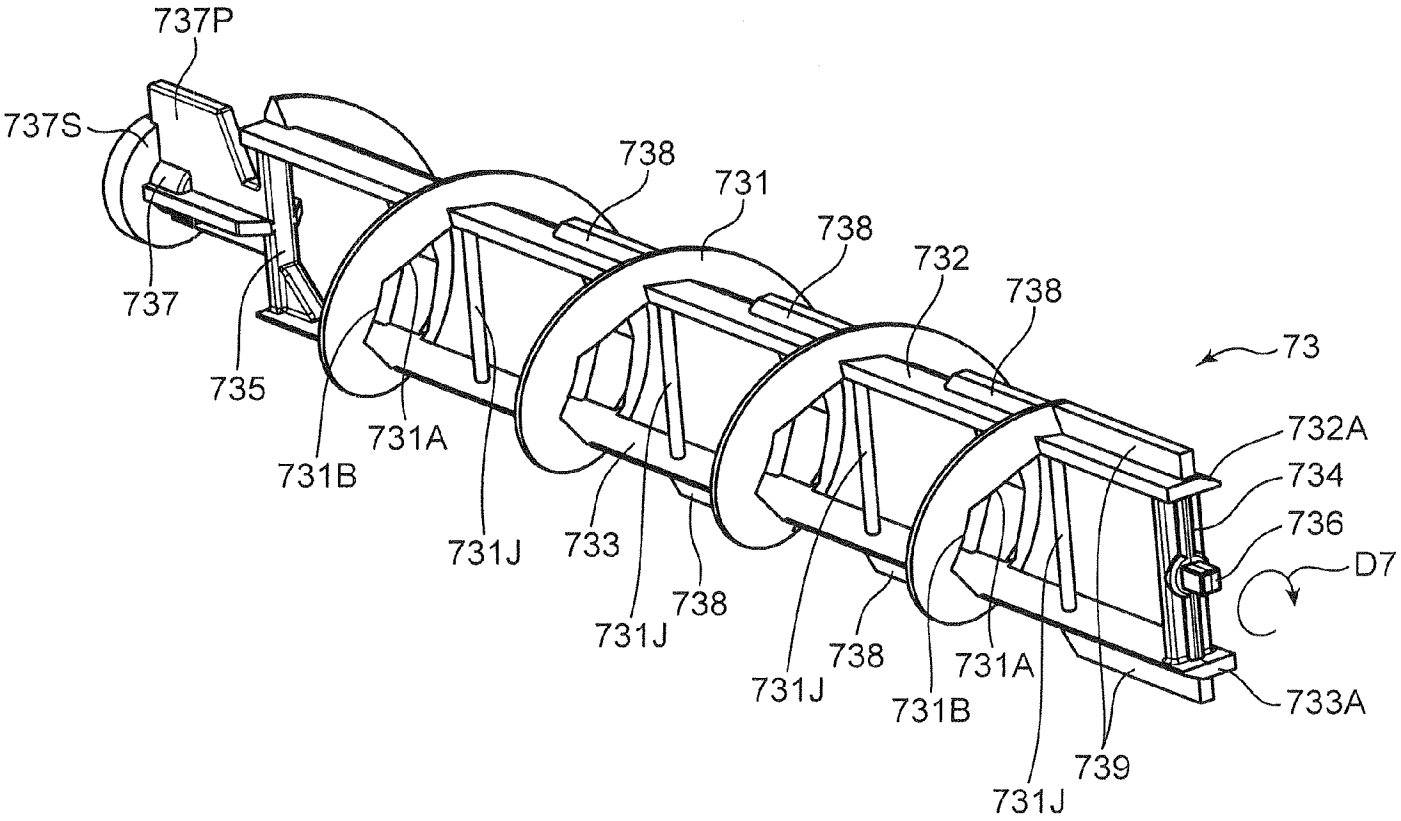
FIG. 10 is a perspective view of a conveyor screw according to another embodiment.
Figure 11:
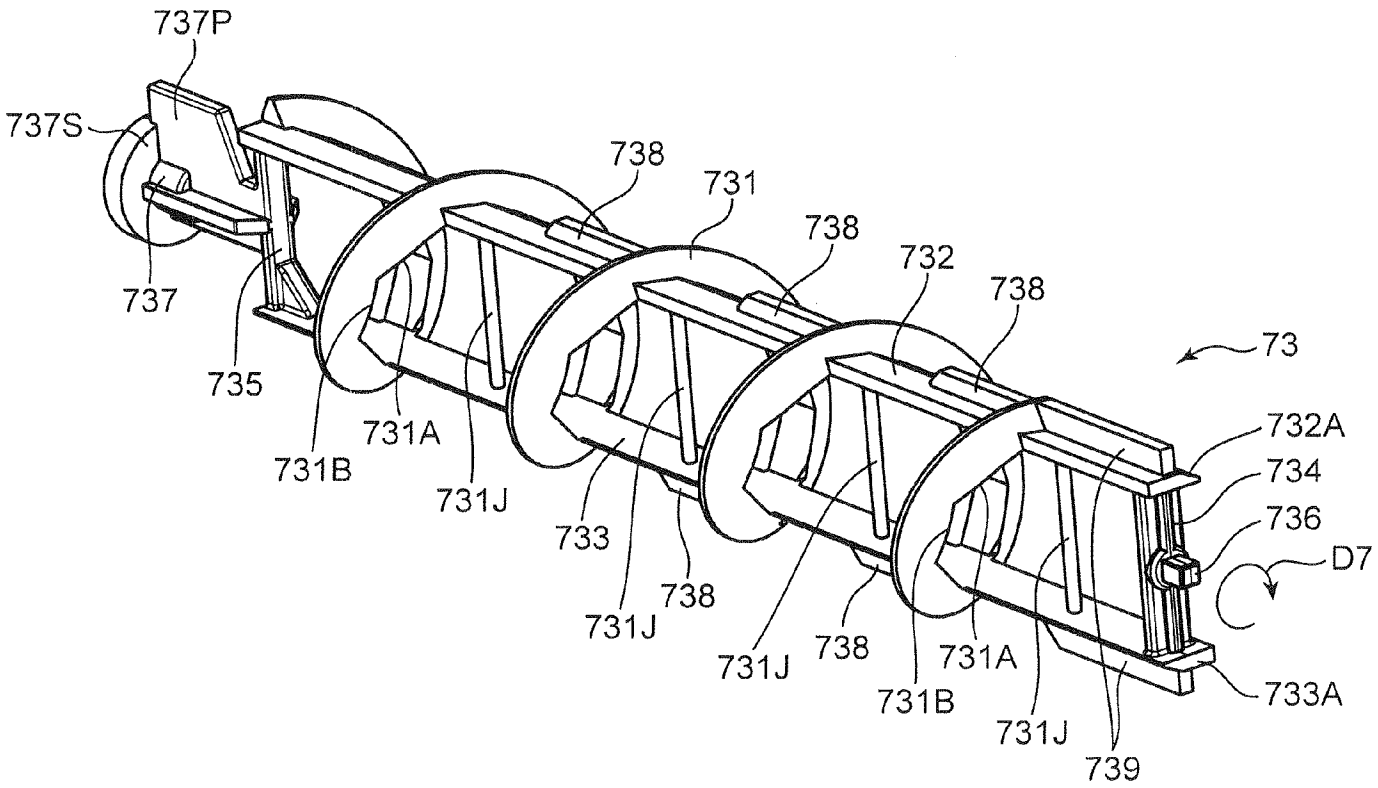
FIG. 11 is a perspective view of a conveyor screw according to still another embodiment.

Next, the first and second conveyor screws 72, 73 arranged in the developing device 70 according to this embodiment are described in detail with reference to FIGS. 4 to 11 in addition to FIGS. 3A and 3B. FIG. 4 is a front view of the first conveyor screw 72, and FIG. 8 is a plan view of the second conveyor screw 73. FIGS. 5 and 9 are respectively perspective views of the first and second conveyor screws 72, 73. FIGS. 6 and 7 are perspective views showing another example of the first conveyor screw 72. FIGS. 10 and 11 are perspective views showing other examples of the second conveyor screw 73.

<Regarding First Conveyor Screw 72>

The first conveyor screw 72 (conveying member) is described with reference to FIGS. 3A, 3B, 4 and 5. As described above, the first conveyor screw 72 is arranged in the first conveying portion 74*a*. The first conveyor screw 72 includes an 11th shaft portion 726 (shaft portion), a 12th shaft portion 727 (shaft portion), an 11th rib 722, a 12th rib 723, an 11th connecting piece 724 (supporting member), a 12th connecting piece 725 (supporting member), a first screw 721, a first seal 727S and a plurality of first breaking members 721J (breaking member).

The 11th and 12th shaft portions 726, 727 are respectively rotatably supported on the second and first wall portions 70C and 70B. The 11th and 12th shaft portions 726, 727 are shaft parts which serve as a rotary shaft of the first conveyor screw 72. The 11th and 12th shaft portions 726, 727 respectively support the first conveyor screw 72 rotatably on one end side and the other end side of the first conveyor screw 72 in the axial direction.

The 11th shaft portion 726 is a tubular body having an inner space which serves as a bearing portion. An unillustrated projection projecting from the second wall portion 70C of the developer housing 70A toward the first conveying portion 74*a* is inserted into the bearing portion of the 11th shaft portion 726. Similarly, the 12th shaft portion 727 is a tubular body having an inner space which serves as a bearing portion. An unillustrated projection projecting from the first wall portion 70B of the developer housing 70A toward the first conveying portion 74*a* is inserted into the bearing portion of the 12th shaft portion 727. As a result, the first conveyor screw 72 is rotatably supported in the developer housing 70A. At this time, a virtual rotary shaft of the first conveyor screw 72 is formed between the 11th and 12th shaft portions 726, 727 in the axial direction of the first conveyor screw 72.

The 11th rib 722 (rib member) and the 12th rib 723 (rib member) are plate-like members respectively extending from one end side to the other end side of the first conveyor screw 72. Further, the 11th and 12th ribs 722, 723 are plate-like members having a predetermined width in a circumferential direction of the first conveyor screw 72. The 11th and 12th ribs 722, 723 are arranged in parallel to face each other with the rotary shaft of the first conveyor screw 72 as a center. In other words, the 11th and 12th ribs 722, 723 are arranged at an interval of 180° in the circumferential direction of the first conveyor screw 72. The 11th and 12th ribs 722, 723 extend from the vicinity of the 11th shaft portion 726 to the vicinity of the 12th shaft portion 727 in the axial direction of the first conveyor screw 72. The 11th and 12th ribs 722, 723 have a function of supporting the first screw 721 to be described later and agitating the developer in the first conveying portion 74*a*.

The first screw 721 is stably supported by a plurality of rib members by arranging the 11th and 12th ribs 722, 721 as the plurality of rib members at an interval in the circumferential direction. As a result, the rotation of the first conveyor screw 721 can be stabilized.

The 11th connecting piece 724 is arranged to face the second wall portion 70C and connects end parts of the 11th and 12th ribs 722, 723 at one end side in a radial direction of the first conveyor screw 72. Further, the 11th shaft portion 726 described above projects axially outward of the first conveyor screw 72 from a central part of the 11th connecting piece 724. In other words, the 11th connecting piece 724 connects the end parts of the 11th and 12th ribs 722, 723 in the conveying direction to the 11th shaft portion 726. Similarly, the 12th connecting piece 725 connects end parts of the 11th and 12th ribs 722, 723 at the other end side in the radial direction of the first conveyor screw 72. Further, the 12th shaft portion 727 described above projects axially outward of the first conveyor screw 72 from a central part of the 12th connecting piece 725.

The 11th rib 722 includes an 11th leading end portion 722A at the outer side of the 11th connecting piece 724 in the axial direction of the first conveyor screw 72. The 11th leading end portion 722A is formed since one end of the 11th rib 722 projects axially outward (toward the second wall portion 70C) from the 11th connecting piece 724. Further, the 11th rib 722 includes an 11th rear end portion 722B at the outer side of the 12th connecting piece 725 in the axial direction of the first conveyor screw 72. The 11th rear end portion 722B is formed since the other end of the 11th rib 722 projects axially outward (toward the first wall portion 70B) from the 12th connecting piece 725.

Similarly, the 12th rib 723 includes a 12th leading end portion 723A at the outer side of the 11th connecting piece 724 in the axial direction of the first conveyor screw 72. The 12th leading end portion 723A is formed since one end of the 12th rib 723 projects axially outward from the 11th connecting piece 724. Further, the 12th rib 723 includes a 12th rear end portion 723B at the outer side of the 12th connecting piece 725 in the axial direction of the first conveyor screw 72. The 12th rear end portion 723B is formed since the other end of the 12th rib 723 projects axially outward from the 12th connecting piece 725.

The first screw 721 (spiral member) spirally extends in the developer conveying direction and forms the outer peripheral edge of the first conveyor screw 72. The first screw 721 is formed by connecting spiral pieces, each forming one spiral turn, in the conveying direction. The first screw 721 includes a hollow interior defined by the spiral pieces connected to each other. In other words, the first screw 721 is a spiral conveying member extending along an axial center coaxial with the virtual rotary shaft of the first conveyor screw 72 between the 11th and 12th shaft portions 726, 727 and including a hollow interior.

The aforementioned 11th and 12th ribs 722, 723 bridge adjacent ones of the spiral pieces of the first screw 721. The first screw 721 is composed of a plurality of the spiral pieces, and these plurality of spiral pieces are united by the pair of 11th and 12th ribs 722, 723, with the result that the spiral first screw 721 having a hollow part at an axial center side is formed. Note that, as shown in FIGS. 3B, 4 and 5, areas where the first screw 721 is not arranged are present at opposite axial end parts of the 11th and 12th ribs 722, 723.

With reference to FIG. 4, a spiral part of the first screw 721 includes a ridge part 721R forming the outer peripheral edge of the first screw 721 having a maximum diameter and a pair of inclined surfaces 721P, 721Q extending from the ridge part 721R to respectively face one and the other axial end sides in a cross-section including the rotary shaft of the first conveyor screw 72. The outer peripheral edge in the cross-section may have, for example, a circular or elliptical curved shape or another shape.

A plurality of planar portions connected in the circumferential direction of the first conveyor screw 72 are arranged on the inner side of the spiral part of the first screw 721. Specifically, on the inner side (underside) of the ridge part 721R of the first screw 721, the pair of inclined surfaces 721P, 721Q are connected by the planar portions.

This point is described in more detail. With reference to FIG. 3A, a first inner wall portion 721S (inner wall portion) is arranged on an inner peripheral part of the first screw 721. The first inner wall portion 721S faces the hollow interior of the first screw 721 and is formed such that the plurality of planar portions are connected at predetermined angles in the circumferential direction. The first inner wall portion 721S is composed of a 11th inner wall surface 721A, a 12th inner wall surface 721B, a 13th inner wall surface 721C, a 14th inner wall surface 721D, a 15th inner wall surface 721E, a 16th inner wall surface 721F, a 17th inner wall surface 721G and an 18th inner wall surface 721H (all are planar portions). These inner wall surfaces form a substantially regular octagonal shape in a cross-section intersecting with the axial direction of the first conveyor screw 72. That is, these inner wall surfaces are connected at a constant angle in the circumferential direction. Note that the 13th and 17th inner wall surfaces 721C, 721G respectively correspond to inner surface portions of the 12th and 11th ribs 723, 722. Specifically, the inner surface portions of the plate-like 12th and 11th ribs 723, 722 facing the hollow interior form some of the plurality of inner wall surfaces of the first screw 721.

Note that the first inner wall portion 721S may be such that a plurality of planar portions are connected at predetermined angles which are not constant. Further, the inner wall surface of the first conveyor screw 72 may be circular or elliptical in the cross-section intersecting with the axial direction of the first conveyor screw 721 and the shape thereof is not limited to a specific shape.

The first breaking member 721J is a long and narrow bar-like member arranged across the hollow interior in a direction intersecting with the developer conveying direction. The first breaking member 721J is desirably a member having a small diameter so as not to hinder the conveyance of the developer and may, for example, be a bar-like member extending like a needle or a wire. Further, the first breaking member 721J may be a bar-like member obtained, for example, by stretching a flexible wire across the hollow interior in the first screw 721.

The first breaking member 721J is coupled to the inner peripheral part of the first screw 721 across the hollow interior in the direction intersecting with the developer conveying direction. In an example shown in FIG. 3A, one end of the first breaking member 721J is coupled to the 11th inner wall surface 721A and the other end thereof is coupled to the 15th inner wall surface 721E. A plurality of the first breaking members 721J are arranged at intervals in the developer conveying direction. The one and other ends of the first breaking member 721J are respectively coupled to the 11th and 15th inner wall surfaces 721A, 721E in the spiral piece forming one spiral turn. This enables the first breaking member 721J to intersect with the developer conveying direction at an angle which is as close to a right angle as possible.

The first screw 721 is formed with holes penetrating through the first screw 721 in a radial direction. In this embodiment, the openings of the holes are formed on the 11th and 15th inner wall surfaces 721A, 721E. For example, the one and other ends of the first breaking members 721J made of wire materials such as wires are inserted into the respective holes. The one and other ends of the first breaking members 721J inserted into the respective holes are respectively engaged with the outer wall surface of the first screw 721, whereby the first breaking members 721J are attached to the first screw 721.

Note that the both ends of the first breaking member 721J may not necessarily be coupled to the first screw 721. For example, as shown in FIG. 6, the one end of the first breaking member 721J may be coupled to the inner wall surface of the first screw 721 and the other end thereof may be coupled to the inner wall surface of the 11th rib 722. Further, the one end of the first breaking member 721J may be coupled to the inner wall surface of the 11th rib 722 and the other end thereof may be coupled to the inner wall surface of the 12th rib 723, for example, as shown in FIG. 7.

The first seal 727S is a circular ring-shaped elastic member arranged radially outward of the 12th shaft portion 727. The first seal 727S is held in contact with an inner wall portion of the first wall portion 70B of the developer housing 70A in a state where the first screw 721 is mounted in the developer housing 70A. As a result, the first seal 727S suppresses the aggregation of the developer between the 12th shaft portion 727 and the inner wall portion of the first wall portion 70B according to the rotation of the first conveyor screw 72.

Further, the first screw 721 includes 11th projections 728 and a 12th projection 729. The 11th projections 728 are wall portions radially projecting from radially outer wall parts of the 11th and 12th ribs 722, 723. The 11th projections 728 project up to a height slightly inwardly of the outer peripheral edge of the first screw 721 in the radial direction of the first conveyor screw 72. Further, a base end part of the 11th projection 728 is connected to one blade part of the first screw 721 in the axial direction of the first conveyor screw 72. The other end part of 11th projection 728 is arranged between another blade part arranged adjacent to the one blade part of the first screw 721 and the one blade part. In other words, the first projection 728 extends from the one blade part of the first screw 721 in a direction (arrow Da of FIG. 3B, arrow D42 of FIG. 4) in which the first conveyor screw 72 conveys the developer in the first conveying portion 74*a*. On the other hand, a leading end part of the 11th projection 728 in its extending direction is arranged substantially in a central part between the above two blade parts without being connected to the other blade part arranged adjacent to the one blade part.

Similarly, the 12th projection 729 is a wall portion radially projecting from a radially outer wall part of the 11th rib 722. The 12th projection 729 is arranged to have a predetermined length in the axial direction on an end part of the 11th rib 722 at the side of the 11th shaft portion 726. An axial outer end part of the 12th projection 729 is arranged to be flush with that of the 11th leading end portion 722A.

<Regarding Second Conveyor Screw 73>

Next, the second conveyor screw 73 is described with reference to FIGS. 3A, 3B, 8 and 9. Note that since the shape of the second conveyor screw 73 is similar to that of the first conveyor screw 72, parts common to the first conveyor screw 72 are not described and points of difference from the first conveyor screw 72 are mainly described in detail. As described above, the second conveyor screw 73 is arranged in the second conveying portion 74*b*. The second conveyor screw 73 includes a 21st shaft portion 736, a 22nd shaft portion 737, a 21st rib 732, a 22nd rib 733, a 21st connecting piece 734, a 22nd connecting piece 735, a paddle 737P, a second screw 731, a second seal 737S and a plurality of breaking members 731J (breaking member).

The 21st and 22nd shaft portions 736, 737 correspond to the 11th and 12th shaft portions 726, 727 of the first conveyor screw 72. The second conveyor screw 73 is rotatably supported in the developer housing 70A by the 21st and 22nd shaft portions 736, 737. At this time, a virtual rotary shaft of the second conveyor screw 73 is formed between the 21st and 22nd shaft portions 736, 737 in the axial direction of the second conveyor screw 73.

The 21st and 22nd ribs 732, 733 correspond to the 11th and 12th ribs 722, 723 of the first conveyor screw 72. The 21st and 22nd connecting pieces 734, 735 correspond to the 11th and 12th connecting pieces 724, 725 of the first conveyor screw 72. Note that, as shown in FIG. 8, the 22nd connecting piece 735 is arranged axially inwardly of and at a predetermined distance from the 22nd shaft portion 737. End parts of the 21st and 22nd ribs 732, 733 also extend up to positions axially inwardly of and at a predetermined distance from the 22nd shaft portion 737 and are connected to each other by the 22nd connecting piece 735.

The 21st rib 732 includes a 21st leading end portion 732A at the outer side of the 21st connecting piece 734 in the axial direction of the second conveyor screw 73. The 21st leading end portion 732A is formed since one end of the 21st rib 732 projects axially outward (toward the second wall portion 70C) from the 21st connecting piece 734. Similarly, the 22nd rib 733 includes a 22nd leading end portion 733A at the outer side of the 21st connecting piece 734 in the axial direction of the second conveyor screw 73. The 22nd leading end portion 733A is formed since one end of the 22nd rib 733 projects axially outward from the 21st connecting piece 734. Note that the 21st and 22nd ribs 732, 733 of the second conveyor screw 73 extend until they intersect with the 22nd connecting piece 735 and do not extend axially outward from the 22nd connecting piece 735 unlike the first conveyor screw 72.

The paddle 737P is a plate-like member arranged axially outwardly of the 22nd connecting piece 735. The paddle 737P radially extends from the rotary shaft of the second conveyor screw 73. In this embodiment, the paddle 737P projects from the rotary shaft in a direction toward the arrangement position of the 21st rib 732. The 22nd shaft portion 737 is connected to an axially outer part of the paddle 737P. Further, the second seal 737S to be described later is connected to an axially outer end edge of the paddle 737P. The paddle 737P has a function of transferring the developer from the second conveying portion 74*b* to the first conveying portion 74*a* via the first communicating portion 704.

The second screw 731 corresponds to the first screw 721 of the first conveyor screw 72. The shape of the second screw 731 in a cross-section including the rotary axis of the second conveyor screw 73 is also similar to the first conveyor screw 72.

Particularly, with reference to FIG. 3A, a second inner wall portion 731S is arranged on an inner peripheral part of the second screw 731. The second inner wall portion 731S is formed such that a plurality of planar portions are connected at predetermined angles. The second inner wall portion 731S is composed of a 21st inner wall surface 731A, a 22nd inner wall surface 731B, a 23rd inner wall surface 731C, a 24th inner wall surface 731D, a 25th inner wall surface 731E, a 26th inner wall surface 731F, a 27th inner wall surface 731G and a 28th inner wall surface 731H. These inner wall surfaces form a substantially regular octagonal shape in a cross-section intersecting with the axial direction of the second conveyor screw 73. Note that the 24th and 28th inner wall surfaces 731D, 731H respectively correspond to inner surface portions of the plate-like 22nd and 21st ribs 733, 732.

Note that the second inner wall portion 731S may be such that a plurality of planar portions are connected at predetermined angles, all of which are not constant. Further, the inner wall surface of the second conveyor screw 73 may be circular or elliptical in the cross-section intersecting with the axial direction of the second conveyor screw 731 and the shape thereof is not limited to a specific shape.

The second breaking member 731J is shaped similarly to the first breaking member 721J in the first conveyor screw 72. The second breaking member 731J is coupled to the inner peripheral part of the second screw 731 across the hollow interior in a direction intersecting with the developer conveying direction. In the example shown in FIG. 3A, one end of the second breaking member 731J is coupled to the 21st inner wall surface 731A and the other end thereof is coupled to the 25th inner wall surface 731E. A plurality of the second breaking members 731J are arranged at intervals in the developer conveying direction.

The one and other ends of the second breaking member 731J are coupled to the 21st and 25th inner wall surfaces 731A, 731E in the spiral piece forming one spiral turn. This enables the second breaking member 731J to intersect with the developer conveying direction at an angle which is as close to a right angle as possible.

The 21st and 25th inner wall surfaces 731A, 731E of the second screw 731 are formed with holes penetrating through the second screw 731. The one and other ends of the second breaking members 731J are inserted into the respective holes and engaged with the outer wall surface of the second screw 731. In this way, the second breaking members 731J are attached to the second screw 731.

The both ends of the second breaking member 731J may not necessarily be coupled to the second screw 731. For example, as shown in FIG. 10, the one end of the second breaking member 731J may be coupled to the inner wall surface of the second screw 731 and the other end thereof may be coupled to the inner wall surface of the 22nd rib 733. Further, the one end of the second breaking member 731J may be coupled to the inner wall surface of the 21st rib 732 and the other end thereof may be coupled to the inner wall surface of the 22nd rib 733, for example, as shown in FIG. 11.

If at least one end of the second breaking member 731J is coupled to the inner wall surface of the 21st or 22nd rib 732 or 733, the second breaking member 731J is easily arranged to be perpendicular to the developer conveying direction as compared with the case where the both ends of the second breaking member 731J are coupled to the second screw 731.

The second seal 737S is a circular ring-shaped elastic member arranged radially outward of the 22nd shaft portion 737. The second seal 737S is held in contact with an inner wall portion of the first wall portion 70B of the developer housing 70A in a state where the second conveyor screw 73 is mounted in the developer housing 70A. As a result, the second seal 737S suppresses the aggregation of the developer between the 22nd shaft portion 737 and the inner wall portion of the first wall portion 70B according to the rotation of the second conveyor screw 73.

Further, the second screw 731 includes 21st projections 738 and 22nd projections 739. The 21st projections 738 correspond to the 11th projections 728 of the first conveyor screw 72.

On the other hand, the 22nd projections 739 are a pair of wall portions radially projecting from radially outer wall parts of the 21st and 22nd ribs 732, 733. The 22nd projections 739 are arranged to have a predetermined length in the axial direction on end parts of the 21st and 22nd ribs 732, 733 at the side of the 21st shaft portion 736. Note that axial outer end parts of the 21st and 22nd leading end portions 732A, 733A project slightly more axially outward than axial outer end parts of the 22nd projections 739.

<Regarding Functions and Effects of First and Second Breaking Members 721J, 731J>

Next, functions and effects of the first breaking members 721J of the first conveyor screw 72 according to this embodiment are described. Note that the following effect and functions are the same as with the second breaking members 731J of the second conveyor screw 73.

As described above, the first screw 721 of the first conveyor screw 72 is a hollow spiral conveying member. In other words, the first conveyor screw 72 includes no shaft part between the 11th and 12th shaft portions 726, 727. This prevents the developer with increased viscosity from adhering to the shaft part when the developer in the developer storage 74 is deteriorated or when an environment surrounding the developing device 70 reaches a high temperature. If the developer with increased viscosity adheres to the shaft part, the conveying performance of the conveyor screw including the shaft part is reduced. The first conveyor screw 72 according to this embodiment can solve such a problem by including the above hollow shape.

On the other hand, if the fluidity of the developer decreases due to a high-temperature environment or with the deterioration of the developer, the developer is more likely to stay in the hollow interior of the first screw 721. As a result, the developer may aggregate while having a cylindrical shape with a maximum outer diameter at the inner wall part of the first screw 721.

However, the first conveyor screw 72 includes the first breaking members 721J arranged across the hollow interior in the direction intersecting with the developer conveying direction. Thus, even if the developer cylindrically aggregates in the hollow interior of the first screw 721, the first breaking members 721J rotate together with the first screw 721 across the developer. Therefore, the aggregated developer is broken by the first breaking members 721J rotating across the developer. As a result, the first breaking members 721J can suppress the cylindrical aggregation of the developer in the hollow part of the first screw 721.

Note that the first breaking members 721J may not necessarily be configured to rotate together with the first screw 721. Even if the first breaking members 721J are held stationary in the hollow interior, they can break the aggregated developer to a certain extent by being arranged across a moving direction of the developer.

The aggregation of the developer as described above is notable in the case of one-component developer. This is because carrier acts to suppress the aggregation of toner in the case of two-component developer composed of the toner and the carrier. In the two-component developer composed of the carrier and the toner, the carrier collides with the toner as the developer is agitated. Thus, the aggregation of the toner is less likely to occur as compared with the one-component developer. On the other hand, in the one-component developer, the above action is less likely to occur and the toner is likely to cylindrically aggregate in the hollow interior of the first screw 721. Even in such a case, the aggregation of the one-component toner is effectively suppressed according to the first conveyor screw 72 including the first breaking members 721J.

An effect of breaking the aggregated developer by the first breaking members 721J becomes larger as an angle between the first breaking members 721J and the moving direction of the developer becomes closer to a right angle. Accordingly, the first screw 72 is so configured that the first breaking member 721J is coupled to the 11th and 15th inner wall surfaces 721A, 721E in the spiral piece forming one spiral turn. In this way, the angle between the first breaking members 721J and the moving direction of the developer easily becomes closer to a right angle.

Further, since the one and other ends of each first breaking member 721J are respectively coupled to the first screw 721, it is not necessary to separately provide a member for supporting the first breaking members 721J in addition to the first screw 721. Thus, it becomes possible, for example, to omit the 11th and 12th ribs 722, 723.

Further, if the one or both ends of each first breaking member 721J are coupled to the inner wall surface of the 11th or 12th rib 722 or 723, the first breaking members 721J is easily arranged to be perpendicular to the developer conveying direction as compared with the case where the both ends of the first breaking members 721J are coupled to the first screw 721. As a result, it becomes easier to increase the effect of breaking the aggregated developer by the first breaking members 721J.

Also in the configuration in which one or both ends of each breaking member 721J are coupled to the inner wall surface of the 11th or 12th rib 722 or 723, the strength of the first conveyor screw 72 can be improved by the first breaking members 721J.

By arranging the plurality of first breaking members 721*j* at predetermined intervals, the developer is broken at a plurality of positions, with the result that an effect of preventing the cylindrical aggregation of the developer increases. Further, an effect of improving the strength of the first conveyor screw 72 also increases. Note that there may be only one first breaking member 721J.

<Regarding Functions and Effects of First and Second Inner Wall Portions 721S, 731S>

Next, functions and effects of the first inner wall portion 721S of the first conveyor screw 72 according to this embodiment are described. Note that the following functions and effects are the same as with the second inner wall portion 731S of the second conveyor screw 73.

If the inner wall of the first screw 721 is composed of a curved surface continuous in the circumferential direction, the developer arranged inside this inner wall is more likely to cylindrically aggregate. On the other hand, as described above, the first conveyor screw 72 according to this embodiment includes the first inner wall portion 721S. Specifically, the first inner wall portion 721S is formed by connecting a plurality of planar portions at predetermined angles. The first inner wall portion 721S forms a substantially regular octagonal shape in the cross-section intersecting with the axial direction of the first conveyor screw 72 as shown in FIG. 3A.

According to such a first inner wall portion 7215, a pressure whose magnitude cyclically varies is applied to the developer being conveyed inside the first screw 721. Specifically, when the inner wall of the first screw 721 is viewed from the virtual rotary shaft part of the first conveyor screw 72 in the above cross-section, a trace of the inner wall of the first screw 721 changes between surface parts represented by the $11^{th}$ inner wall surface 721A and intersection parts of the plurality of surfaces according to the rotation of the first screw 721. A cross-sectional shape of the first inner wall portion 721S is not a circular shape having a uniform inner diameter, but an irregular shape having a varying diameter. Due to the irregular shape, an aggregate of the developer arranged in the hollow interior of the first screw 721 tends to be broken if the first screw 721 is rotated. As a result, the first inner wall portion 721S has a function of breaking an aggregate of the toner inside the first screw 721 even if the fluidity of the developer decreases.

Further, a pressure whose magnitude cyclically varies is applied to the developer arranged inside the first screw 721. As a result, even if the fluidity of the developer decreases, the first inner wall portion 721S has the function of breaking an aggregate of the toner inside the first screw 721. Thus, as described above, the cylindrical aggregation of the developer inside the first screw 721 is suppressed. The second inner wall portion 731S of the second conveyor screw 73 also achieves similar functions and effects. Note that cross-sectional shapes of the first and second inner wall portions 721S, 731S are not limited to substantially regular octagonal shapes. Functions and effects similar to the above are achieved by connecting a plurality of planar parts at predetermined angles in the circumferential direction on the inner wall part of the first screw 721 or the second screw 731.

Further, in the above embodiment, the cylindrical aggregation of the developer in the hollow interior of the first screw 721 is suppressed in the image forming apparatus 1 including the developing device 70. Thus, the adhesion of an aggregate of the toner to the developing roller 71 is prevented. Therefore, the occurrence of image quality defects caused by the supply of an aggregate of the toner to the photoconductive drum 31 is suppressed.

Although the developing device 70 and the image forming apparatus 1 including this according to the embodiment of the present disclosure are described above, the present disclosure is not limited to this and can be, for example, modified as follows.

(1) Although the developer conveying device is described using the interior of the developing device 70 in the above embodiment, the present disclosure is not limited to this. A toner container, a toner cartridge, a waste toner conveying device or the like may be applied as the developer conveying device including the first or second conveyor screw 72 or 73. Even in this case, the cylindrical aggregation of developer is suppressed in the hollow interior of the first or second screw 721 or 731.

(2) Although the first and second conveyor screws 72, 73 are supported on the developer housing 70A at the opposite axial end parts in the above embodiment, the present disclosure is not limited to this. The first and second conveyor screws 72, 73 may be supported on the developer housing 70A at one axial ends.

(3) Although the first conveyor screw 72 includes the $11^{th}$ and $12^{th}$ ribs 722, 723 and the second conveyor screw 73 includes the $21^{st}$ and $22^{nd}$ ribs 732, 733 in the above embodiment, the present disclosure is not limited to this. All or some of the $11^{th}$, $12^{th}$, $21^{st}$ and $22^{nd}$ ribs 722, 723, 732 and 733 may be omitted. For example, all or some of the $11^{th}$, $12^{th}$, $21^{st}$ and $22^{nd}$ ribs 722, 723, 732 and 733 may be omitted by making the first and second screws 721, 731 of a material with high strength such as metal.

(4) Although the 12th leading end portion 723A, the $12^{th}$ rear end portion 723B, the $22^{nd}$ leading end portion 733A, the $22^{nd}$ rear end portion 733B, the $11^{th}$ projections 728, the $12^{th}$ projection 729, the $21^{st}$ projections 738 and the $22^{nd}$ projections 739 are provided in the above embodiment, the present disclosure is not limited to this. All or some of the $12^{th}$ leading end portion 723A, the $12^{th}$ rear end portion 723B, the $22^{nd}$ leading end portion 733A, the $22^{nd}$ rear end portion 733B, the $11^{th}$ projections 728, the $12^{th}$ projection 729, the $21^{st}$ projections 738 and the $22^{nd}$ projections 739 may be omitted.

According to the present disclosure, in a developer conveying device including a developer conveying member having a hollow shape and a developing device and an image forming apparatus provided with the same, a possibility of cylindrical aggregation of developer in a hollow part can be reduced.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A developer conveying device, comprising:
a housing with first and second walls;
a developer conveyance path extending between the walls; and
a conveying member rotatably supported on the walls and configured to convey developer from the first wall to the second wall, the conveying member including:
a spiral member having opposite first and second ends spaced apart in a conveying direction of the developer and including plural spiral revolutions, a hollow interior being defined inward of the spiral member;
a first shaft portion arranged at the first end of the spiral member and a second shaft portion arranged at the second end of the spiral member, the first and second shaft portions being rotatably supported respectively on the first and second walls and serving as a rotary shaft for rotation of the conveying member; and
a breaking member extending across the hollow interior in a direction intersecting with the conveying direction the breaking member being a bar-like member having first and second ends, at least the first end of the breaking member being coupled to the spiral member, wherein
the hollow interior is arranged between the first wall and the second wall and the conveying member has no shaft in the hollow interior.

2. A developer conveying device according to claim 1, wherein:
the breaking member has opposite ends coupled to the spiral member within the range of one spiral revolution of the spiral member.

3. A developer conveying device according to claim 1, wherein:
the breaking member extends across the hollow interior in a direction substantially perpendicular to the conveying direction.

4. A developer conveying device according to claim 1, wherein:
a plurality of the breaking members are arranged at intervals in the conveying direction.

5. A developing device, comprising:
the developer conveying device of claim 1; and
a developing roller rotatably supported in the housing at a position to receive the developer conveyed by the developer conveying device and being configured to carry developer.

6. A developing device according to claim 5, wherein:
the developer is composed of one-component toner.

7. A developing device according to claim 5, wherein:
the one and other ends of the breaking member are respectively coupled to the spiral member within the range of one spiral turn of the spiral member.

8. A developing device according to claim 5, wherein:
the breaking member extends across the hollow interior in a direction substantially perpendicular to the conveying direction.

9. A developing device according to claim 5, wherein:
a plurality of the breaking members are arranged at intervals in the conveying direction.

10. An image forming apparatus, comprising:
the developing device of claim 5; and
an image bearing member configured such that an electrostatic latent image is to be formed on a circumferential surface thereof, and arranged to face the developing roller.

11. An image forming apparatus according to claim 10, wherein:
the developer is composed of one-component toner.

12. A developer conveying device, comprising:
a housing with a pair of walls;
a developer conveyance path extending between the walls; and
a conveying member rotatably supported on the walls and configured to convey developer from a first wall to a second wall, the conveying member including:
a spiral member having opposite ends spaced apart in a conveying direction of the developer and including plural spiral revolutions, a hollow interior being defined inward of the spiral member;
shaft portions arranged at opposite ends of the spiral member and being rotatably supported on the walls and serving as a rotary shaft for rotation of the conveying member, and;
a breaking member extending across the hollow interior in a direction intersecting with the conveying direction;
a rib member extending in the conveying direction and bridging adjacent ones of the spiral revolutions of the spiral member; and
a supporting member arranged to face the wall and connecting an end part of the rib member in the conveying direction and the shaft portion;
wherein the breaking member is a bar-like member having opposite ends and at least one end thereof is coupled to the rib member.

13. A developer conveying device according to claim 12, wherein:
a plurality of the rib members are arranged at intervals in a circumferential direction of the spiral member.

14. A developing device, comprising:
the developer conveying device of claim 12; and
a developing roller rotatably supported in the housing at a position to receive the developer conveyed by the developer conveying device, the developing roller being configured to carry developer.

15. A developing device according to claim 14, wherein:

a plurality of the rib members are arranged at intervals in a circumferential direction of the spiral member.

16. An image forming apparatus, comprising:

the developing device of claim 14, and an image bearing member configured so that an electrostatic latent image is to be formed on a circumferential surface thereof and arranged to face the developing roller.

* * * * *